US005561968A

United States Patent [19]

Palmer

[11] Patent Number: 5,561,968

[45] Date of Patent: Oct. 8, 1996

[54] AUTOMATED CARTONER

[76] Inventor: Jack A. Palmer, Center Grove Rd., Randolph, N.J. 07869

[21] Appl. No.: 394,873

[22] Filed: Feb. 27, 1995

[51] Int. Cl.[6] ..... B65B 43/24; B65B 43/44; B65B 43/46; B65B 43/48

[52] U.S. Cl. ..... 53/458; 53/473; 53/566; 53/252

[58] Field of Search ..... 53/458, 566, 574, 53/251, 252, 473, 467

[56] References Cited

U.S. PATENT DOCUMENTS

| | | | |
|---|---|---|---|
| 3,299,611 | 1/1967 | Hendrick et al. | 53/566 |
| 3,420,036 | 1/1969 | Hutchinson | 53/566 |
| 3,426,506 | 2/1969 | Jernigan | 53/566 |
| 3,474,594 | 10/1969 | Cannon et al. | 53/566 |
| 3,665,674 | 5/1972 | Bivans et al. | 53/566 X |
| 4,109,444 | 8/1978 | Lee | 53/566 |
| 4,358,918 | 11/1982 | Groom et al. | 53/566 X |
| 4,926,616 | 5/1990 | Zielke et al. | 53/566 X |
| 5,379,570 | 1/1995 | Terjung et al. | 53/566 X |

*Primary Examiner*—Horace M. Culver
*Attorney, Agent, or Firm*—Stroock & Stroock & Lavan

[57] ABSTRACT

An automated cartoner for packaging a product in a carton having score lines is provided. The automated cartoner includes a carton feed for storing a plurality of cartons. A carton slide is provided and is coupled to the carton feed for receiving cartons from the carton feed. A pre-break station is positioned at approximately the midpoint of the carton slide. The pre-break station is provided for flexing the score lines on the carton. A product feed is provided for storing a plurality of products, for example, videotape cassettes. A product slide is provided and is connected at approximately a 90° angle to the carton slide at one end below the pre-break station to form a packaging station. The other end of the product slide is connected to the product feed for receiving product from the product feed. The product slide delivers product to the packaging station. At least one motor is provided for driving the carton slide and the product slide in reciprocating directions with respect to one another. The carton on the carton slide is driven towards the packaging station, while the product on the product slide is driven towards the packaging station and drives the product into the carton to form a packaged product.

26 Claims, 16 Drawing Sheets

134
108
114
150a
116
147
156
154
170
172
174
175
178
180
182
B
G
F

AUTOMATED CARTONER

This invention relates to an automated packaging machine for inserting a package into a carton and, in particular, to an automated cartoner which has a product slide and a carton slide that operate at 90° with respect to one another and move in reciprocating directions thereby creating a simple, efficient and compact packaging system.

The typical automatic cartoning machine is large, and therefore requires a great amount of operating space. These machines include long chain conveyors to move the cartons and product through the system. Such conveyors require large motors and a vast array of pneumatic cylinders in order to control the insertion of the product into the carton. Moreover, chain conveyor systems stretch causing faulty timing.

An example of this system is the CECO Model 50, manufactured by Container Equipment Corporation of Cedar Grove, N.J. In this system, a carton is inserted into an adjustable funneling bucket. The carton and bucket then travel along a chain conveyor. A second chain conveyor running parallel to the first chain conveyor carries product for insertion into the carton. The products then enter an insert station where a vast array of pneumatic cylinders, essentially perpendicular to the conveyors, push the product into the carton to form a packaged product.

In another embodiment of the prior art, a compartment is used to insert the empty carton. This compartment with the opened package therein travels along the conveyor until a product is manually inserted into the carton. Such a system is complicated, requires excess labor and is slow. An example of this system is the CECO Model 40, manufactured by Container Equipment Corporation of Cedar Grove, N.J.

These disadvantages are significant and represent an unsatisfactory mechanism that requires maintenance and impacts on the quality of the operation and the speed at which the packaging operation occurs. It is, therefore, desirable to provide an improved automated cartoner, simplistic in design and function, and more specifically, an automatic cartoner that reduces the number of moving parts and insures positive cycle rapidity throughout the operation to overcome the disadvantages of the prior art.

SUMMARY OF THE INVENTION

Generally speaking, in accordance with the present invention, an automated cartoner for packaging a product in a carton having score lines is provided. The automated cartoner includes a carton feed for storing a plurality of cartons. A carton slide is provided and includes a first end and a second end. The first end of the carton slide is coupled to the carton feed for receiving cartons from the carton feed. A pre-break station is positioned on the carton slide essentially between the first end and the second end. The pre-break station is provided for flexing the score lines on the carton.

A product feed is provided for storing a plurality of products, for example, videotape cassettes. A product slide is provided and includes a first end and a second end. The first end of the product slide is connected at approximately a 90° angle to the carton slide between the pre-break station and the second end of the carton slide to form a packaging station. The first end of the product slide is connected to the product feed for receiving product from the product feed. The product slide delivers product to the packaging station. At least one motor is provided for driving the carton slide and the product slide. The carton on the carton slide is driven towards the packaging station, while the product on the product slide is driven towards the packaging station and drives the product into the carton to form a packaged product.

Accordingly, it is the object of the present invention to provide an improved automated cartoner.

Another object of the present invention is to provide an automated cartoner that is simple and compact in design.

A further object of the present invention is to provide a system that does not use chain conveyors and/or pneumatic cylinders for operation.

A further object of the present invention is to provide an automated cartoner that cuts down on the number of moving parts and insures positive cycle rapidity.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
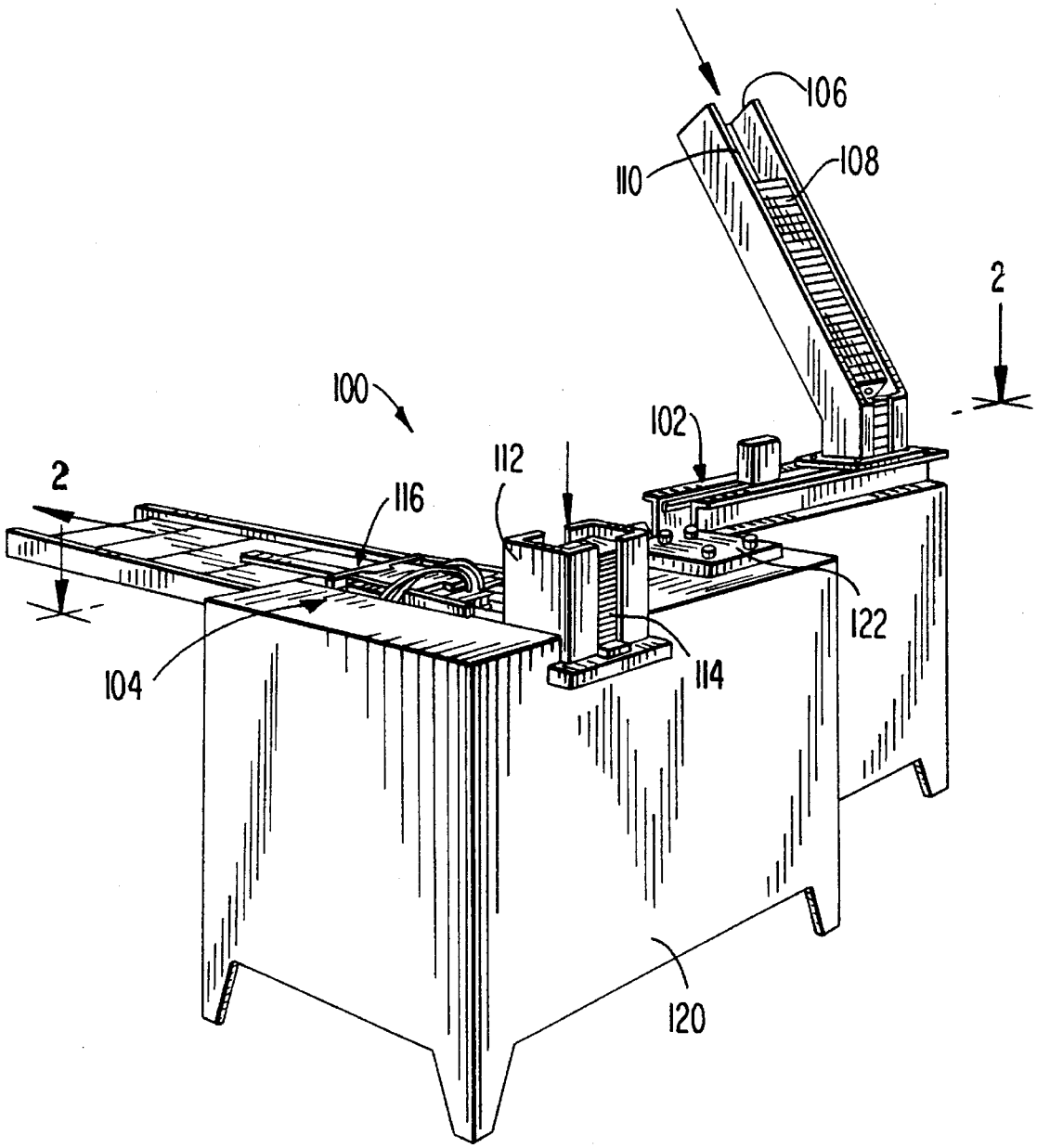
FIG. 1 is a perspective view of an automated cartoner constructed in accordance with a preferred embodiment of the invention.

Reference is first made to FIG. 1 wherein an automated cartoner, generally shown as 100 is depicted. Automated cartoner 100 includes two basic assemblies: a product line 102 and a carton line 104. Product line 102 and carton line 104 are mounted on a base 120. The standard size of automated cartoner 100 is 63 inches long×42 inches wide× 34 inches high and is constructed to interface with conventional folding, feeding and shrink wrap machines.

Base 120 includes a control panel 122 for controlling the operation of the system. The control panel includes at least the following functions: reverse, forward, start, emergency stop and jog (i.e., intermittent movement). Product line 102 includes a product hopper 106 for holding product, and in the preferred embodiment, video cassettes, along a product slide 110. However, the system may be used for any solid or semisolid product that is packaged in a carton including automotive parts, pharmaceuticals, cosmetics, rolls of plastic, foil or the like and frozen foods in a bag or other bagged products.

Carton line 104 includes a carton hopper 112 for storing cartons 114. Cartons 114, in the preferred embodiment, are carton blanks used to package a videotape cassette and identify the contents thereof. Cartons 114 are typically stored flat in product hopper 112 and contain score lines, which flex and bend when the carton is manipulated to form an open package. Automated cartoner 100 handles all types of end loading or similar form of cartons including those cartons having partial overlapping flaps, butting flaps, full flaps and those requiring glue. Cartons 114 are typically constructed from paperboard or corrugated paper. Cartons 114 move along a carton slide 116 as will be described in greater detail below.

Figure 2:
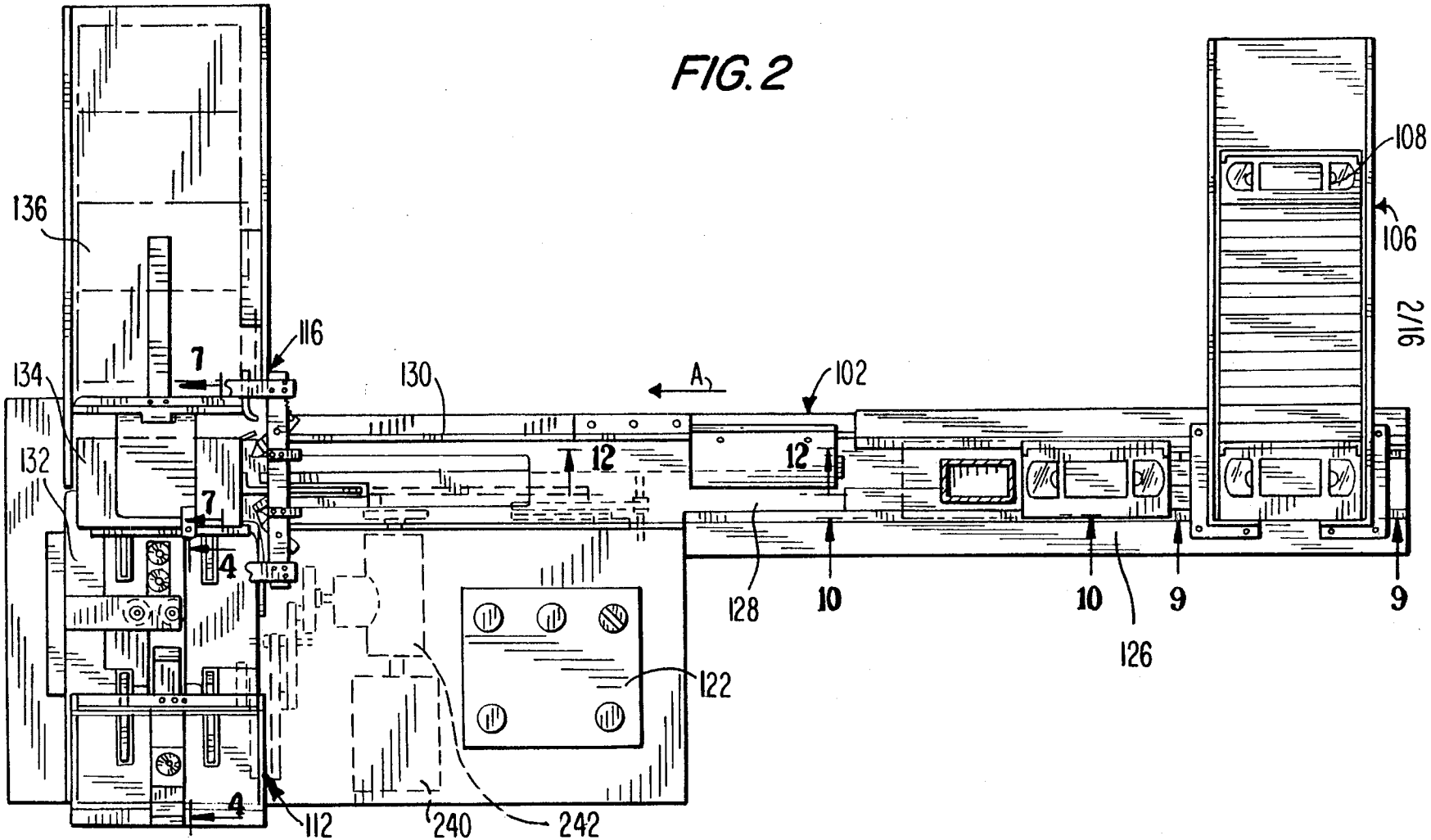
FIG. 2 is an enlarged sectional view taken along lines 2—2 of FIG. 1.

In order to understand the positioning and arrangement of the components of automated cartoner 100 reference is made to FIG. 2, which discloses the various operation stations of automated cartoner 100. Product 108 moves along product slide 110 to at least three different stations in the direction of Arrow A. After product 108 is removed from product hopper 106, product 108 moves along product slide 110 to a labeling station 126. Thereafter, product 108 moves to a reorienting station 128. From there, product 108 moves along product slide 110 to an insert station 130.

At the same time products 108 are moving along product slide 110, cartons 114 move along carton slide 116 in the direction of Arrow B. As carton 114 is removed from carton hopper 112, carton 114 moves along carton slide 116 to a pre-break station 132, which flexes the score lines in carton 114 so that it may be manipulated to an open position. Next, carton 114 moves along carton slide 116 to a product insert station 134. At product insert station 134, product 108 is inserted into carton 114 to form a packaged product. From there, the packaged product is moved along carton slide 116 to a folding station 136. Product line 102 and carton line 104 are connected to one another at approximately 90°. In order to describe the operation of automated cartoner 100, a description of the individual parts of product line 102 and carton line 104 as well as the driving mechanism thereof will hereinafter be described.

Figure 19:
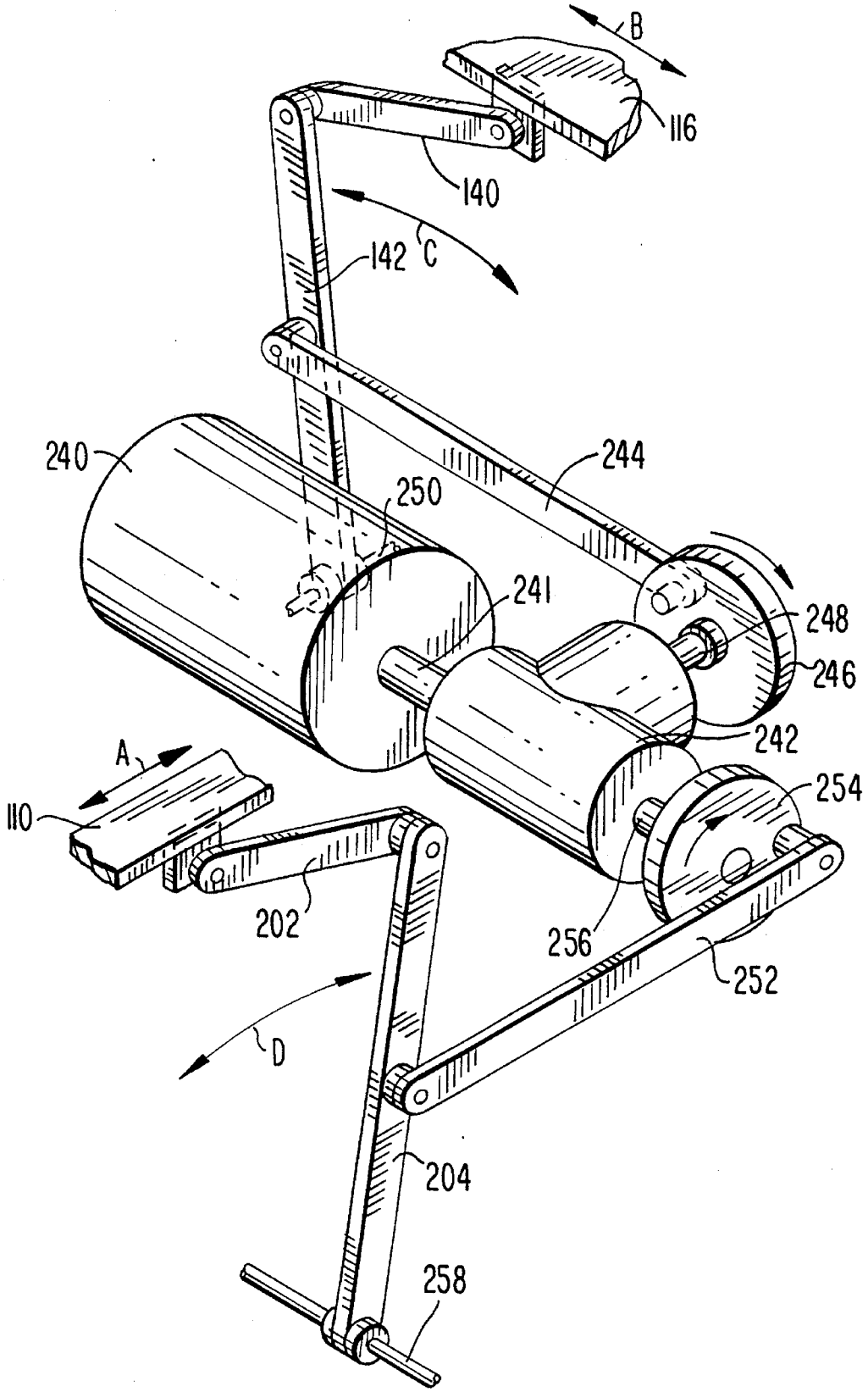
FIG. 19 is a perspective view of the mechanical drive mechanism of the automated cartoner of the present invention.

Reference is now made to FIG. 19 which discloses the mechanism for controlling the movement of product slide 110 of product line 102 and the movement of carton slide 116 of carton line 104. Automated cartoner 100 is driven by a motor 240. In the preferred embodiment, motor 240 is a one-half horse power variable speed motor and uses a simple one-third vacuum pump (not shown but, its function will be described in greater detail below). Motor 240 requires a common 110 volt A.C. power supply. Motor 240 is connected through a drive rod 241 to a right angle drive 242. The positioning of drive motor 240 and right angle drive 242 in automated cartoner 100 is best shown in FIG. 2.

Right angle drive 242 has two drive shafts 248 and 256 for driving carton slide 116 and product slide 110, respectively. Drive shaft 248 is connected to a drive gear 246, which is coupled to a crank arm 244. Crank arm 244 is then connected to essentially the mid point of a connecting arm 142. One end of connecting arm 142 is coupled to a fixed shaft 250, while the other end of connecting arm 142 is connected to a drive arm 140. Drive arm 140 is coupled to carton slide 116.

Product slide 110 is similarly coupled to right angle drive 242. Drive shaft 256 is coupled to a drive gear 254. Drive gear 254 is then coupled to a crank arm 252. Crank arm 252 is coupled to essentially the midpoint of a connecting rod 204. One end of connecting rod 204 is coupled to a fixed shaft 258, while the other free end of connecting rod 204 is connected to a drive rod 202. Drive rod 202 is thereafter coupled to product slide 110.

Right angle drive 242 causes drive gears 246 and 254 to rotate in the clockwise direction as shown by the arrows. In turn, drive gears 246 and 254 cause crank arms 244 and 252 to move back and forth in in reciprocating directions in the direction of Arrows C and D, respectively. Similarly, crank arms 244 and 252 cause connecting rods 142 and 204 to move in reciprocating directions in the direction of Arrows C and D, respectively, which in turn causes drive rods 140 and 202 to move in the same direction. The specific rotation, connection and movement is not critical so long as product slide 110 and carton slide 116 have positive cycle rapidity and move in reciprocating directions. Because drive rods 140 and 202 are coupled to carton slide 116 and product slide 110, respectively, they cause cartons 114 on carton slide 116 to move in the direction of Arrow B and products 108 on product slide 110 to move in the direction of Arrow A as shown in FIGS. 2 and 19. The effect of this specific movement has on product 108 and carton 114 will be described in greater detail, once the specific parts of automatic cartoner 100 are disclosed.

Figure 3:
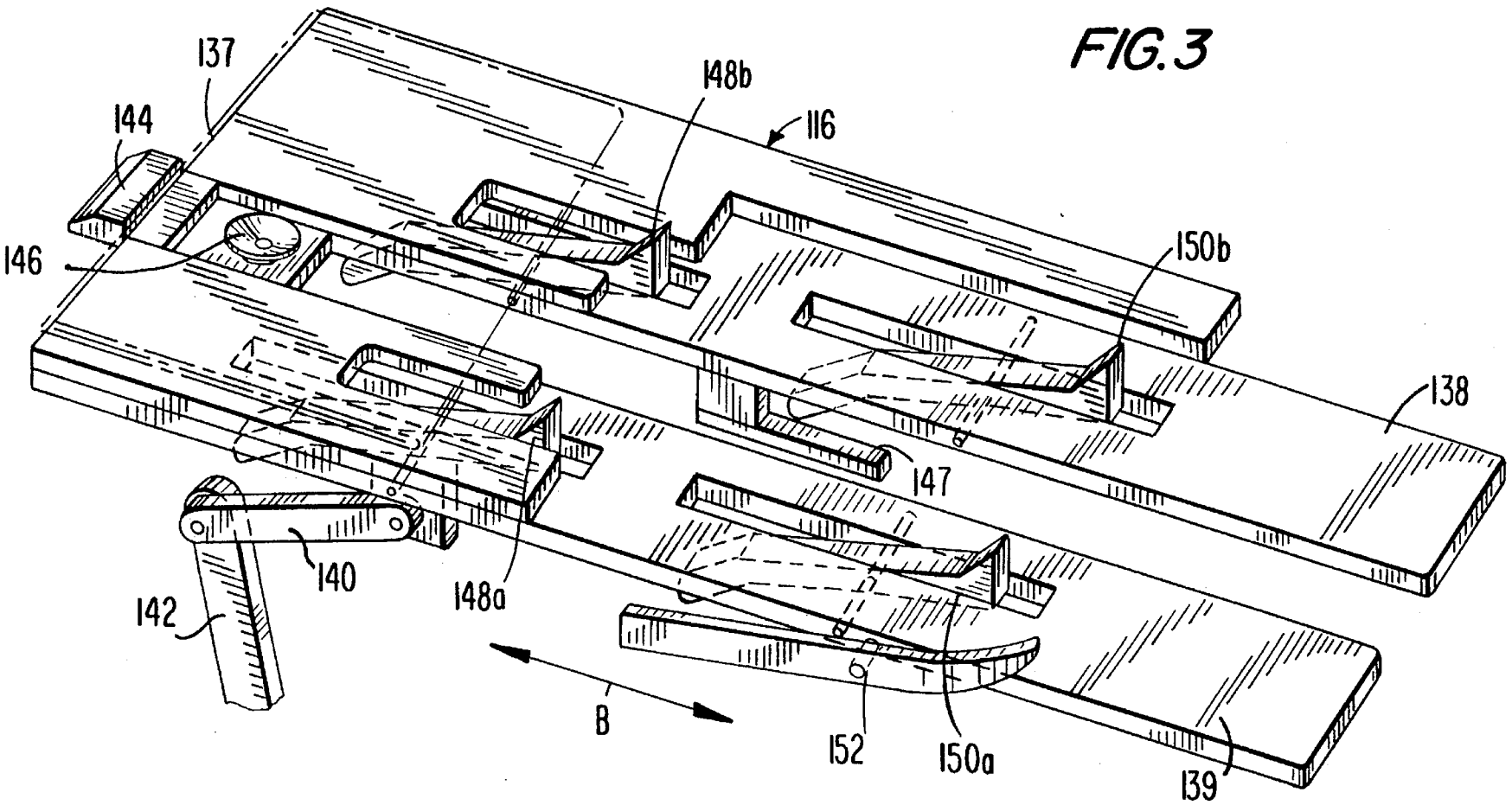
FIG. 3 is a perspective view of the carton slide constructed in accordance with the preferred embodiment of the invention.

Reference is now made to FIG. 3 which discloses carton slide 116. Carton slide 116 is generally a u-shaped member formed with side members 138 and 139 and a base member 137. Side member 138 and 139 have two cut outs. Each cut out receives a respective gravity pusher 148*a*, 148*b*, 150*a* or 150*b*; each mounted about their respective pin. A carton pusher 144 is mounted at the end of carton slide 116 at base 137. Carton pusher 144 extends above base member 137 so as to form a blocking mechanism to push folded carton 114 (shown in phantom lines) through carton line 104.

A suction cup 146 mounted on carton slide 116 is designed to draw air in a downward direction. Suction cup 146 pulls a folded carton 114 from carton hopper 114 so that carton pusher 144 may drive carton 114 to pre-break station 132. A folding member 152 is mounted on side member 139 of a carton slide 116 in the vicinity of gravity pusher 150*a*. Folding member 152 is used to fold the tabs of carton 114 as the packaged product is moved to folding station 136 (FIG. 2). The operation thereof will be described in greater detail below.

Figure 4:
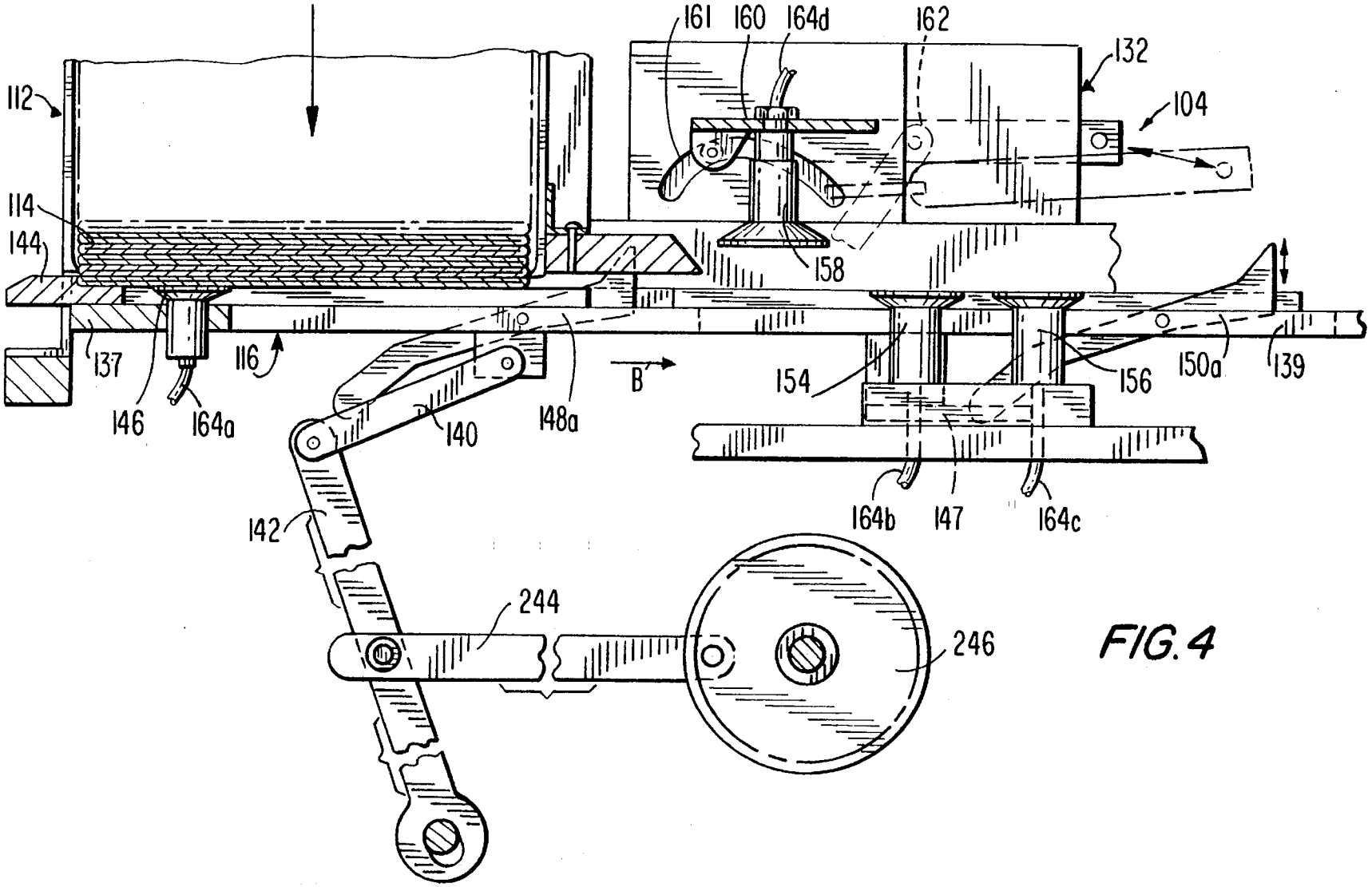
FIG. 4 is an enlarged sectional view taken along lines 4—4 of FIG. 2.

The positioning of carton slide 116 in carton line 104 is shown in FIG. 4. There, carton slide 116 is shown in a first position in which base member 137 is positioned below carton hopper 112. In this position, folded cartons 114 are stacked one upon another within carton hopper 112. As carton slide 116 moves in the direction of Arrow B, suction cup 146 pulls a folded carton 114 out from bottom of carton hopper 112 and then carton pusher 144 pushes carton 114 down along carton line 104 to pre-break station 132 in the direction of Arrow B. Suction cup 146 pulls air in a downward direction through an air tube 164*a* connected to the vacuum pump (not shown).

Figure 5:
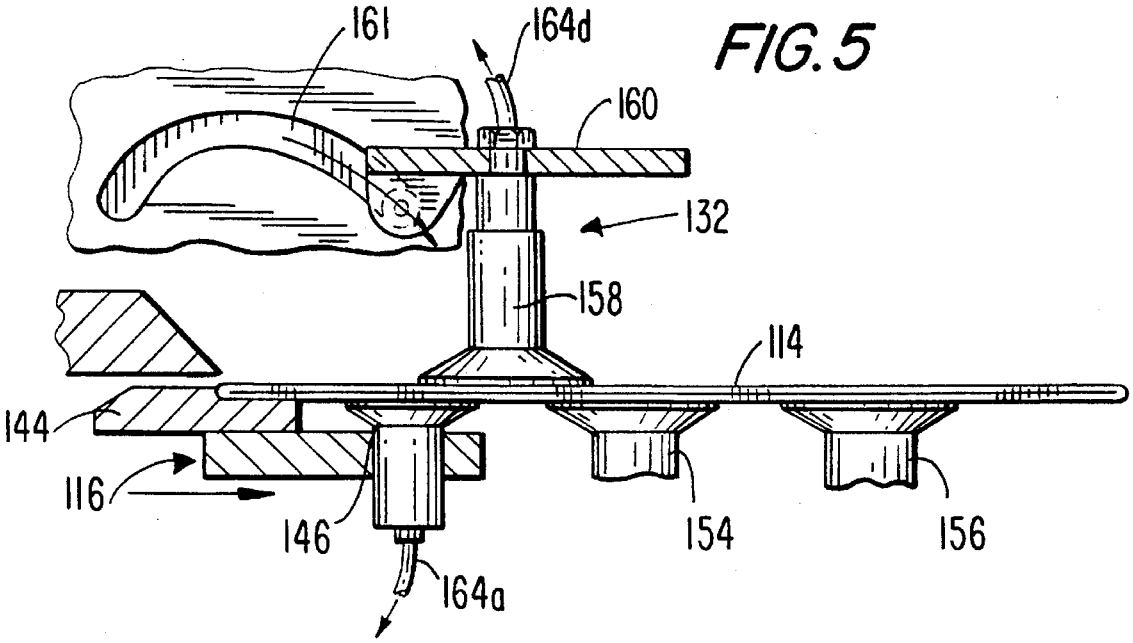
FIG. 5 is a side elevational view of the pre-break station in a first position along the carton slide.

Pre-break station 132 is defined by three separate suction cups. Two suction cups 154 and 156 having air tubes 164*b* and 164*c* connected to the vacuum pump, respectively, are positioned below carton slide 116 for drawing air in a downward direction. A third suction cup 158 is positioned above suction cups 154 and 156. Suction cup 158 includes a mounting assembly 160 having a guide member 161. The movement of suction cup 158 through guide member 161 is shown by comparing its movement in FIGS. 5 and 6.

Figure 6:
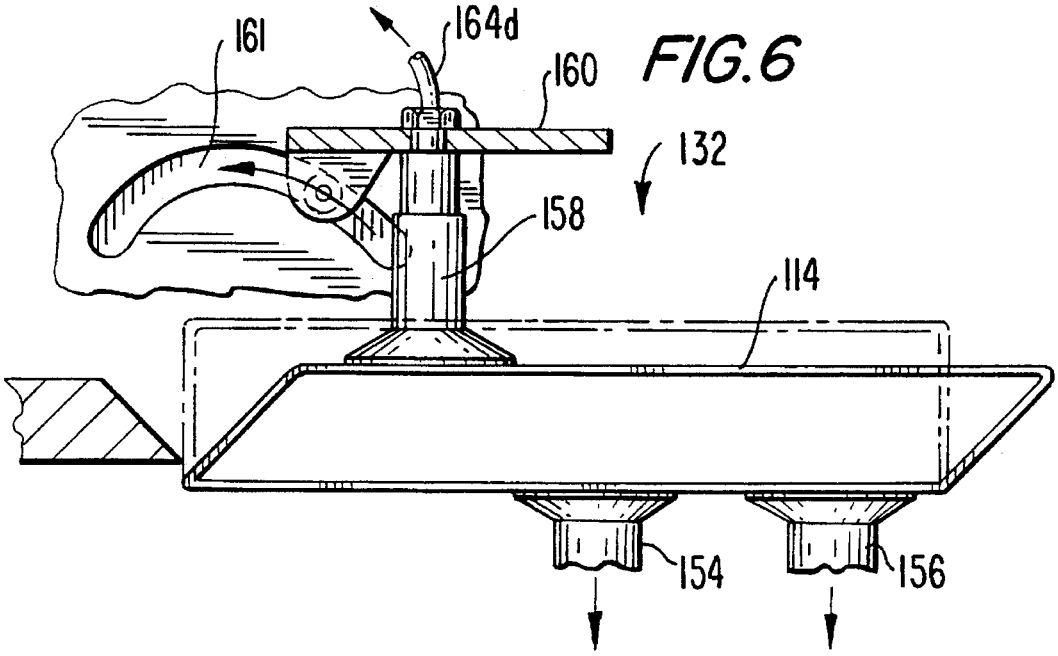
FIG. 6 is a side elevational view of the pre-break station in a second position along the carton slide.

Therefore, as carton slide 116 moves in the direction of Arrow B, a folded carton 114 is pushed by carton pusher 144. Carton 114 is pushed over gravity pushers 148*a* and 148*b* towards pre-break station 132. As carton 114 moves to pre-break station 132, the bottom of carton 114 is pulled in a downward direction by suction cups 154 and 156, while the top of carton 114 is pulled in an upward direction by suction cup 158. As carton 114 continues to move in the direction of Arrow B by the force of gravity pushers 148*a* and 148*b*, suction cups 154 and 156 remain in a fixed position along carton line 104. However, suction cup 158 begins its movement through guide member 161 in the direction of Arrow E as shown in FIG. 6. This movement causes suction cup 158 to raise the top of carton 114 to an open position by flexing the score lines (represented by phantom lines) as best shown in FIG. 6 during the movement of carton 114 along carton slide 116.

Figures 7, 17, 18:
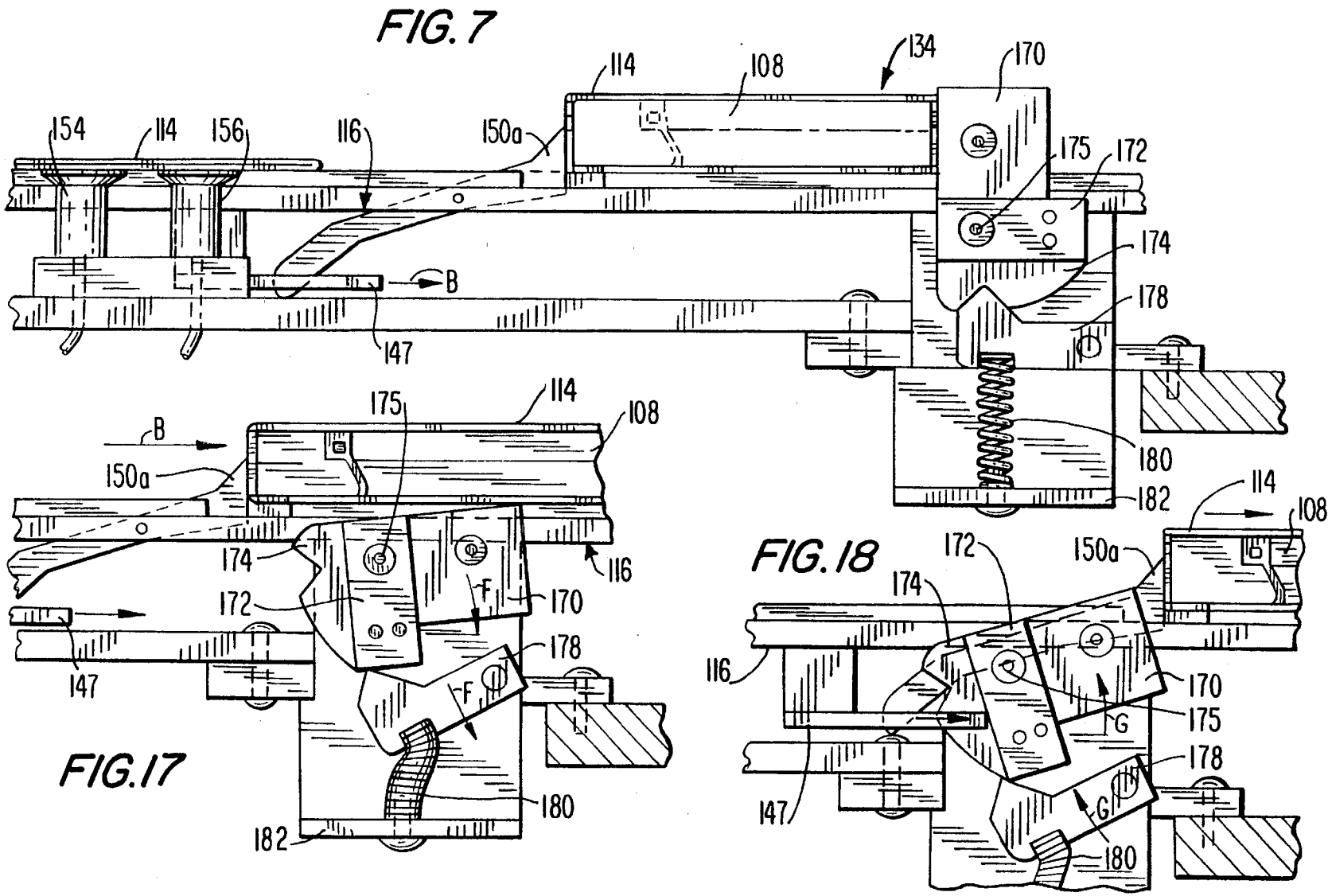
FIG. 7 is an enlarged sectional view taken along lines 7—7 of FIG. 2.
FIG. 17 is a side elevational view of the carton insert station in a first position in accordance with the preferred embodiment of the invention.
FIG. 18 is a side elevational view of the carton insert station in a second position in accordance with the preferred embodiment of the invention.

Reference is now made to FIGS. 7, 17 and 18 which discloses the movement of carton 114 into product insert station 134. Once carton 114 has been pre-broken in pre-break station 132, gravity pushers 148*a* and 148*b* direct carton 114 toward product insert station 134 in the direction of Arrow B. Carton 114 slides over gravity pushers 150*a* and 150*b* to ultimately place gravity pushers 150*a* and 150*b* in a pushing position. Thereafter, gravity pushers 150*a* and 150*b* force carton 114 into an essentially rectangular and open position by the force exerted thereon between gravity pushers 150*a* and 150*b* and a stopper 170. In other words, the force causes the two sides of carton 114 to be essentially perpendicular to carton slide 116.

Stopper 170 is mounted on a base 172. Base 172 is mounted for rotation about a pivot point 175. Base member 172 includes a strike block 174 having a detent portion and a flat portion mounted thereon for engagement with locking member 178. Locking member 178 is spring mounted through spring 180 to a base 182.

Once carton 114 is placed in the position as shown in FIG. 7, it is held in that position momentarily until a product 108 is inserted therein to create a packaged product. The process of inserting product 108 into carton 114 will be described in greater detail below. Now that product 108 is in carton 114, gravity pushers 150*a* and 150*b* move in the direction of Arrow B forcing stopper 170 and base member 172 to pivot around pivot point 175 enabling the packaged product to move past stopper 170 into folding station 136.

As the packaged product moves over stopper 170, stopper 170 essentially aligns with carton slide 116 as best shown in FIG. 17. As this occurs, stopper 170 and locking member 178 move in a downward direction of Arrows F in FIG. 17. As gravity pushers 150*a* and 150*b* move past stopper 170, stopper 170 begins its reorientation back to an upward position as shown by Arrows G in FIG. 18. This reorientation is caused by a push bar 147. Push bar 147 is mounted to the underside of carton slide 116. As push bar 147 moves in the direction of Arrow B, it strikes against the flat portion of strike block 174, thereby driving stopper 170 in the direction of Arrow G shown in FIG. 18. As stopper 170 moves to its upright position as shown in FIG. 7, push bar 147 causes the detent of strike block 174 to engage locking member 178, thereby readying stopper 170 to again block and open carton 114 in the manner described above with respect to FIG. 7.

Figure 8:
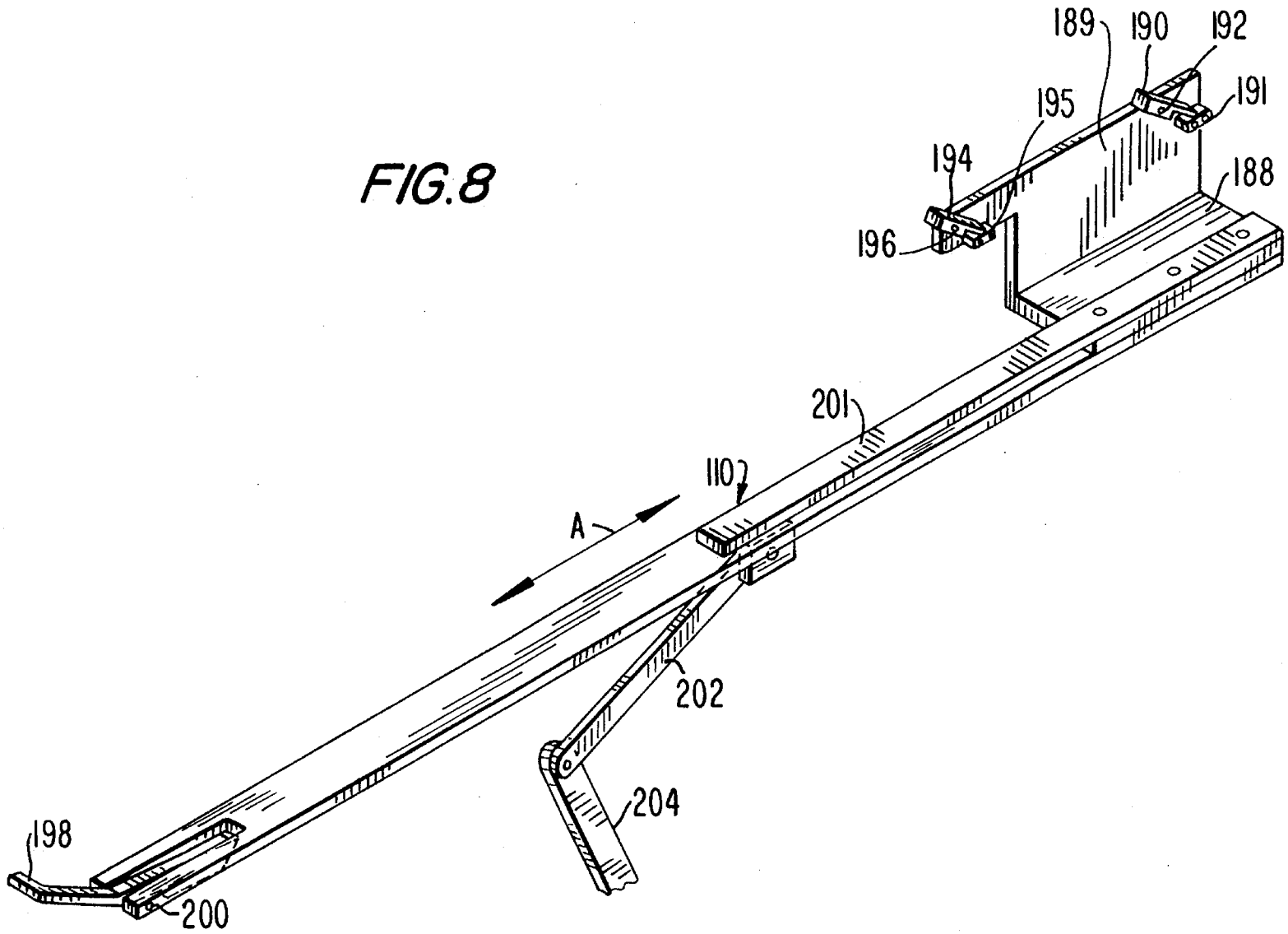
FIG. 8 is a perspective view of the product slide in accordance with the preferred embodiment of the invention.

Turning to FIG. 8, product slide 110 is disclosed. Product slide 110 is mounted to motor 240 through drive rod 202 and connecting rod 204 as described above in greater detail. This interconnection causes product slide 110 to move in the direction of Arrow A. On one end of product slide 110, a connecting plate 189 is provided for engagement with product hopper 106. Connecting plate 189 includes a gravity pusher 190 mounted about a pivot point 192 with a stopper 191. A second stopper 194 is mounted on the opposite end of connecting plate 189 about a pivot point 196 with a stopper 195.

Connecting plate 189 is further mounted to product slide 110 through a mounting plate 188. Positioned above mounting plate 188 is a pusher rod 201 that extends in the direction of Arrow A. At the other end of product slide 110, a third gravity pusher 198 is provided and is mounted about a pivot point 200 for rotation. Gravity pusher 198 is mounted in the region of insert station 130 as shown in FIG. 2.

Figure 9:
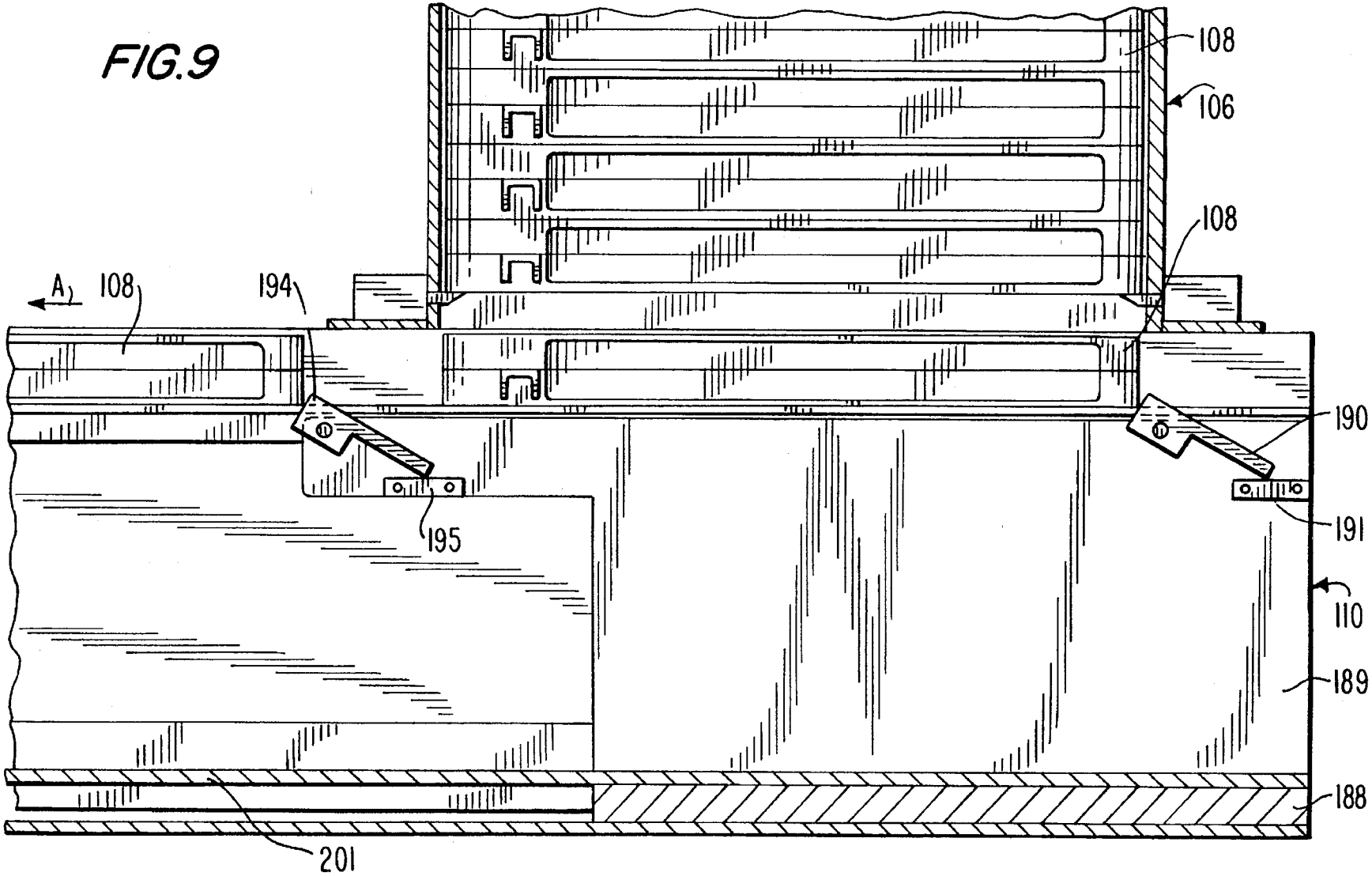
FIG. 9 is an enlarged sectional view taken along lines 9—9 of FIG. 2.

Referring now to FIG. 9, product 108, and in this example, videotape cassettes, are stored one on top of another in product hopper 106. The bottom most product 108 is positioned on the top edge of connecting plate 189. At this time, product 108 is in the ready position to travel along product slide 110 in the direction of Arrow A by gravity pusher 190. Gravity pusher 190 pushes product 108 over gravity pusher 194, thereby causing gravity pusher 194 to pivot in downward direction so that product 108 slides over and past. Once product 108 moves past product hopper 106 in the direction of Arrow A, the next product 108 drops down onto product slide 110.

Figure 10:
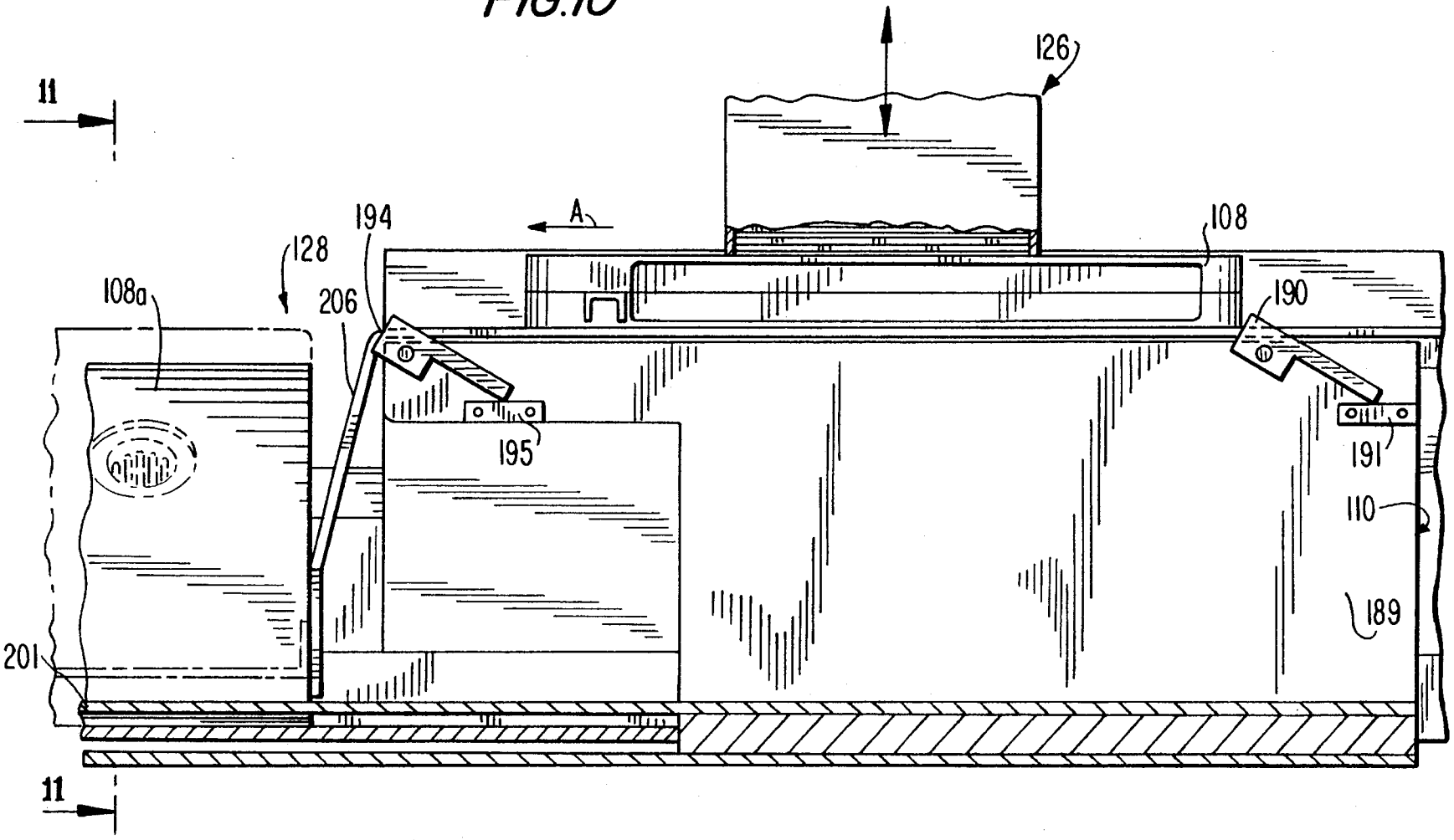
FIG. 10 is an enlarged sectional view taken along lines 10—10 of FIG. 2.

Reference is now made to FIG. 10 which shows product 108 in labelling station 126 just beyond product hopper 106. At labelling station 126, the user may adhere a label onto product 108 or do any other necessary step to the product, manually or automatically, prior to insertion into carton 114. As is apparent from FIG. 10, gravity pusher 190 still controls the movement of product 108 along product slide 110. As product 108 continues its movement in the direction of Arrow A, it is directed towards reorienting station 128.

In reorienting station 128, product 108 is rotated 180° so that the User may do any additional procedure, manually or automatically to the opposite side of product 108 prior to being inserted into carton 114. Any number of gravity pushers 190 and 194 may be placed along product slide 110 depending upon the requirements of the user and the length of product slide 110 prior to the insertion of product 108 into carton 114. For the purposes of this example, the arrangement has been simplified to disclose the role the gravity pushers play in the operation of automated cartoner 100, but in no way to limit the scope of the invention.

Figure 11:
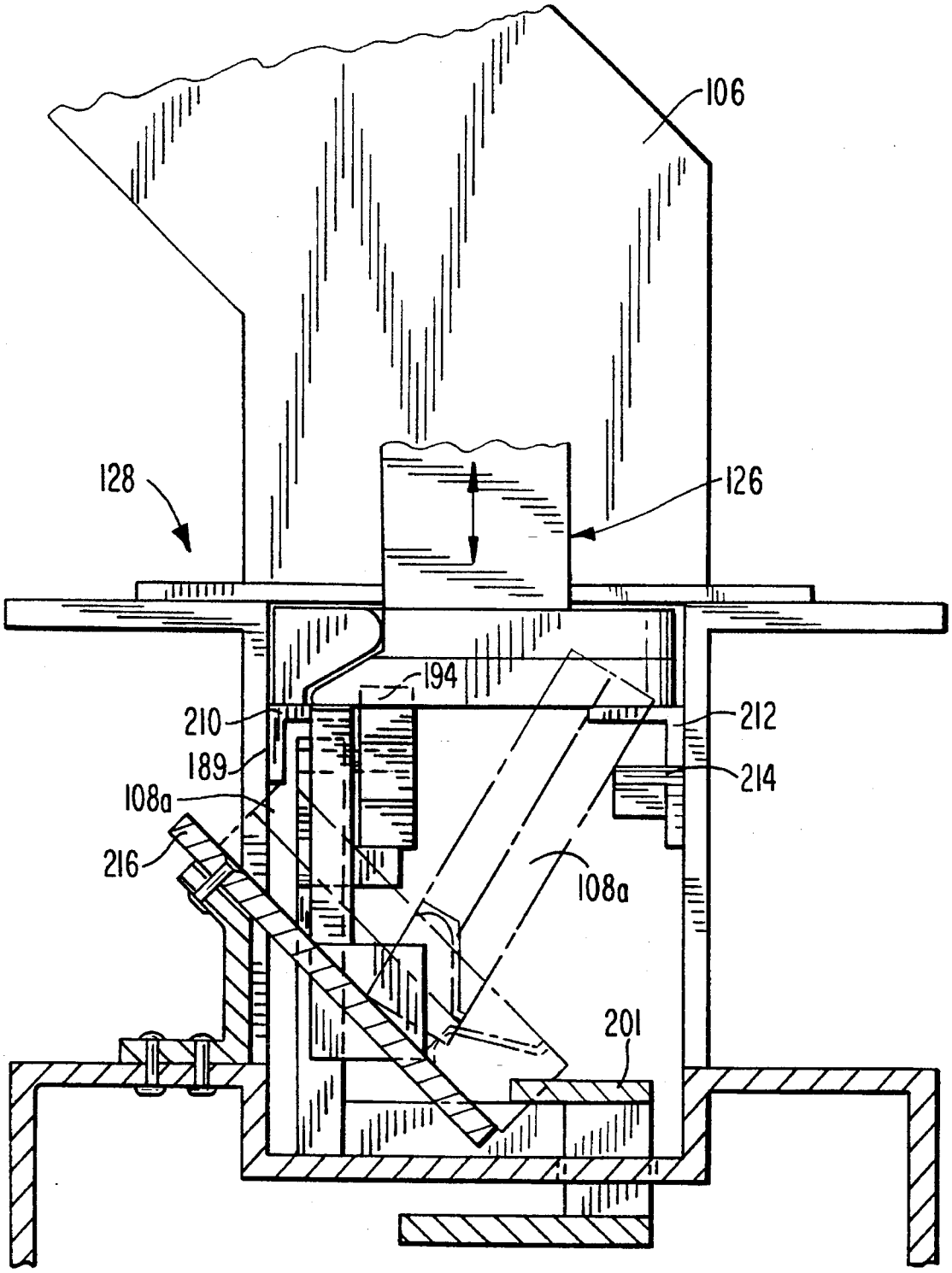
FIG. 11 is an enlarged cross-sectional view taken along lines 11—11 of FIG. 10.

As product 108 continues its movement along product slide 110 in FIG. 10, product 108 pushes against another product right in front of it, in this example, product 108*a* as shown in FIG. 10. Therefore, gravity pusher 194 pushes product 108*a* towards reorienting section 128. Once product 108*a* enters reorienting section 128, the front end of tape 108*a* strikes stopper 214 as shown in FIG. 11 and passes over guide rails 210 and 212. In this manner, the end/side of product 108*a* closest to connecting plate 189 drops downward, rests against stop plate 216 and then slides downward towards the bottom most portion of product slide 110. This movement causes the top of product 108*a* to flip over and onto stop plate 216 as represented by the phantom lines shown in FIG. 11. Product 108*a* enters into this region by means of gravity pusher 194. Pusher rod 201 will eventually make contact with the back end of product 108*a* to push it in the direction of Arrow A along product slide 110 towards insert station 130, when in the appropriate cycle.

Figure 12:
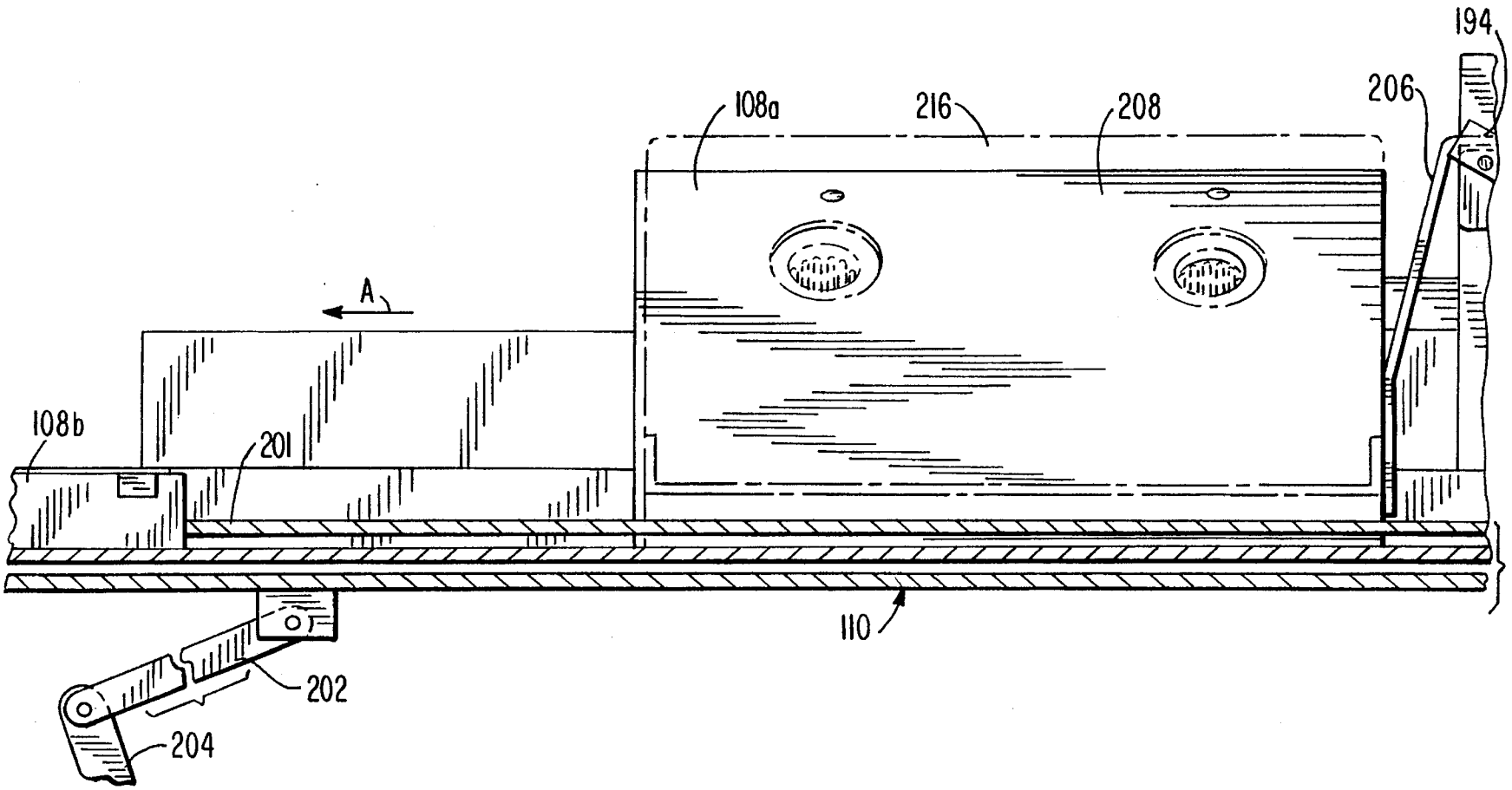
FIG. 12 is an enlarged sectional view taken along lines 12—12 of FIG. 2.

Product 108*a* shown in its upside down position along stop plate 216 is best shown in FIG. 12. While product 108*a* momentarily rests in this position, pusher rod 201 is directing product 108*b* in front of product 108*a* in the direction of Arrow A towards insert station 130. As product slide 110 retracts in a direction opposite to Arrow A, pusher rod 201 aligns with the back end of product 108*a*, which will be described in greater detail below.

Figure 14:
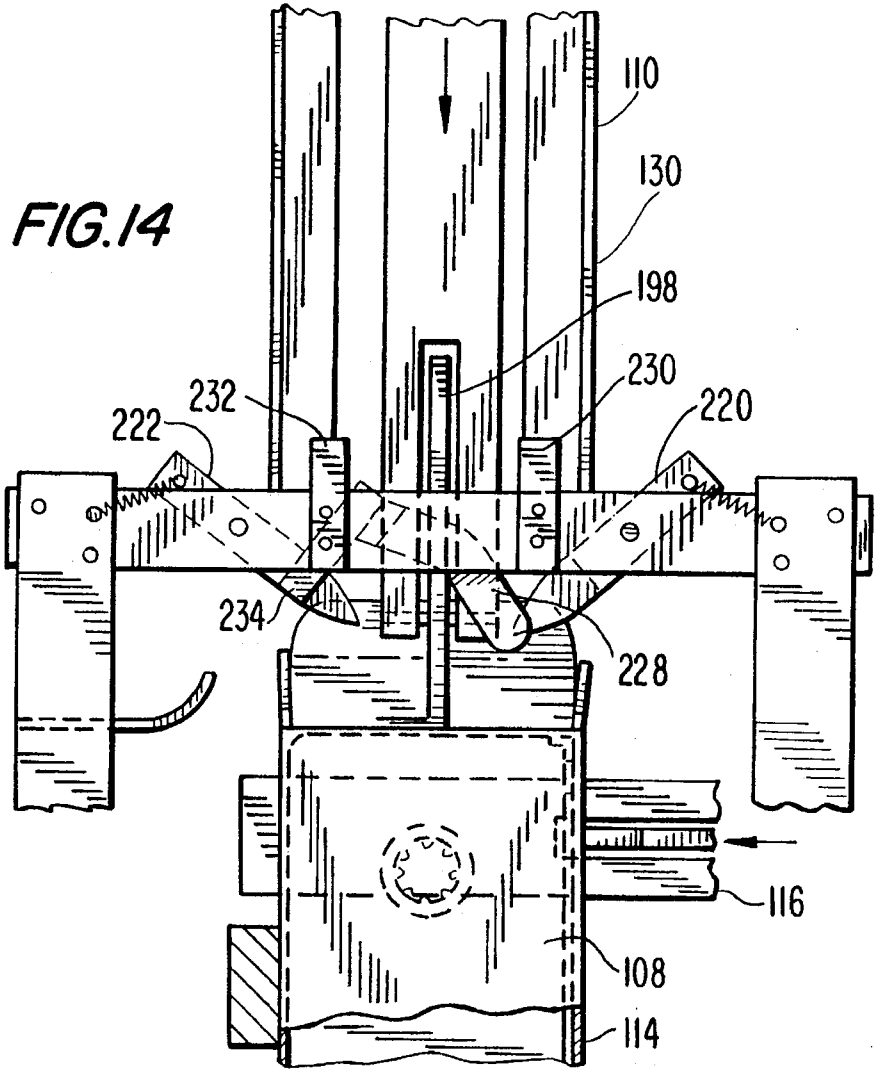
FIG. 14 is a top plan view of the insert station and carton insert station in a second position in accordance with the preferred embodiment of the invention.
Figure 13:
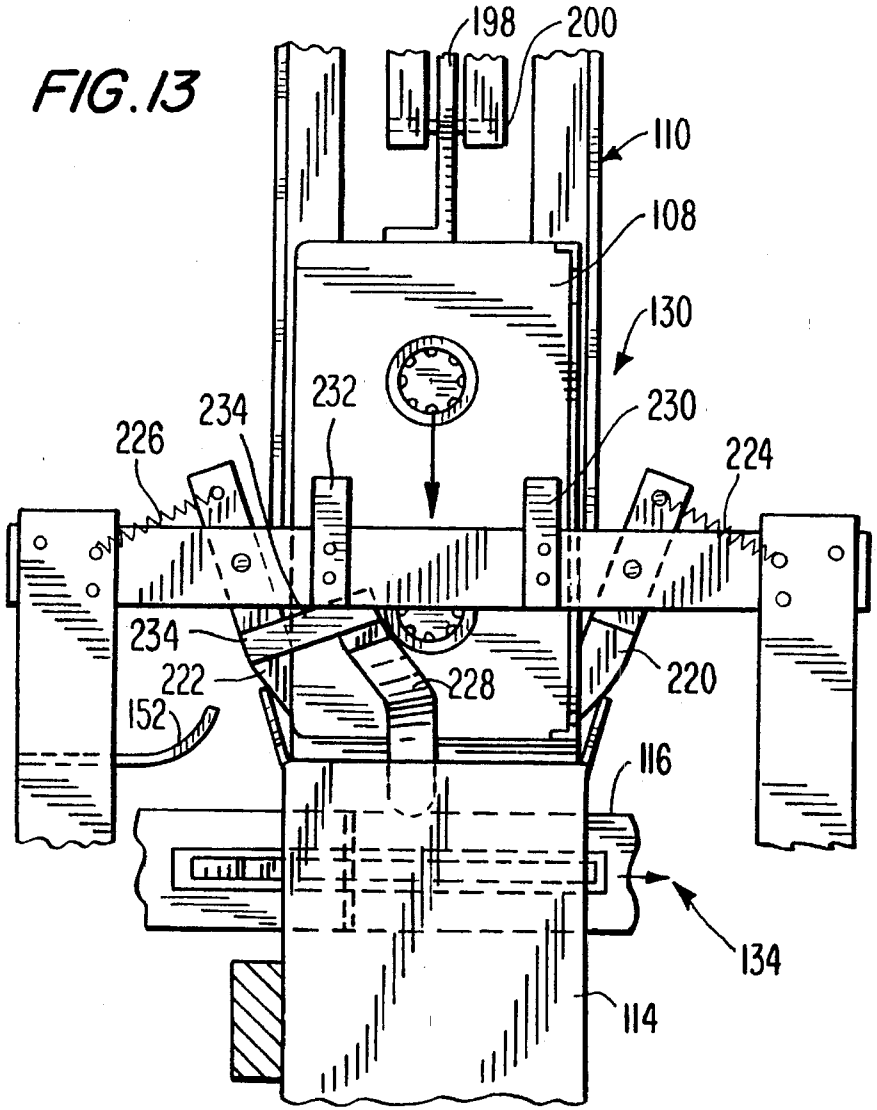
FIG. 13 is a top plan view of the insert station and carton insert station in a first position in accordance with the preferred embodiment of the invention.
Figure 15:
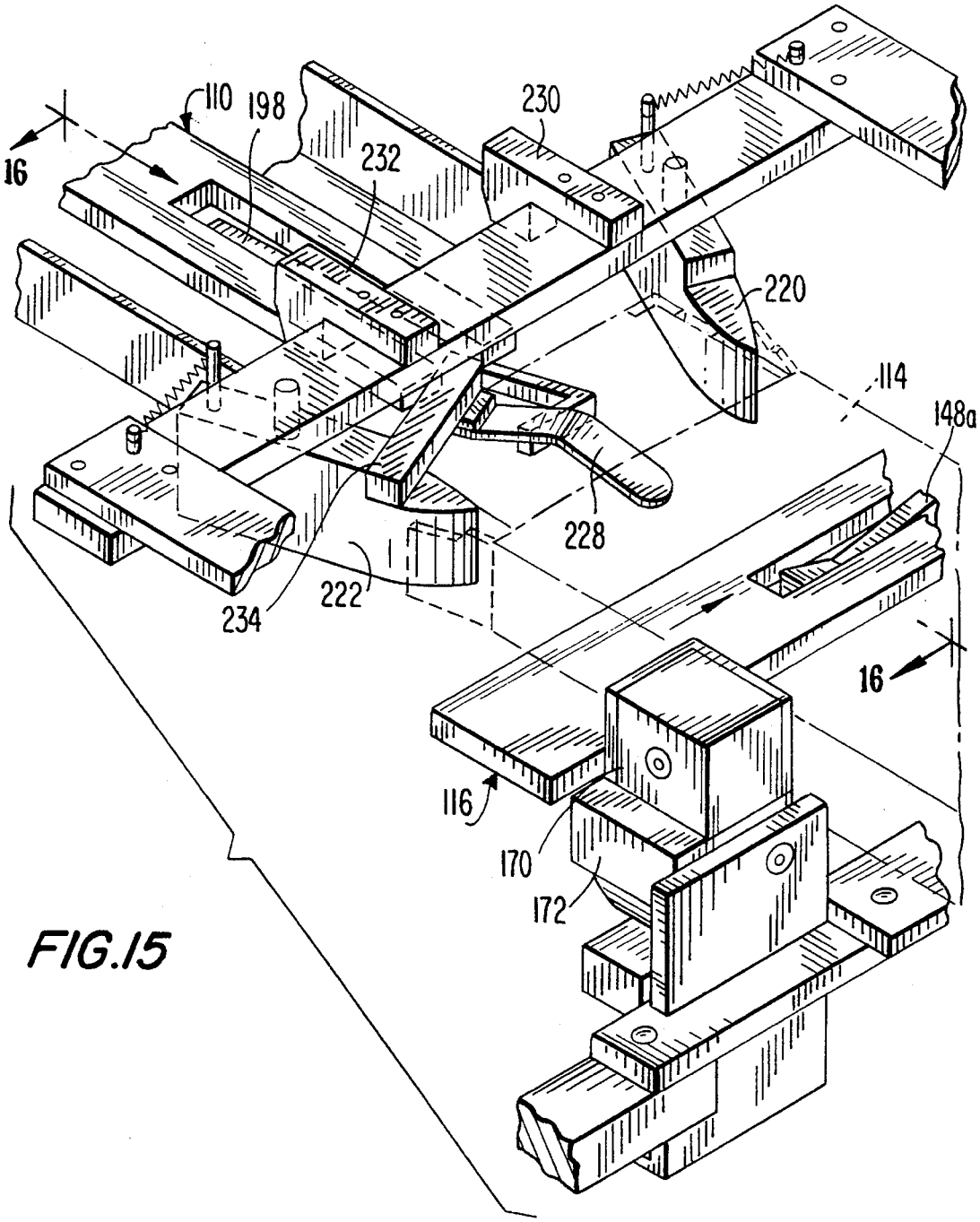
FIG. 15 is an exploded perspective view of the insert station and the carton inserting station.

Reference is now made to FIGS. 13, 14 and 15 which disclose product 108 moving from insert station 130 to product insert station 134. Product slide 102 engages carton slide 104 at essentially its midpoint at approximately a 90° angle. Product 108 is pushed into product insert station 134 by means of gravity pusher 198. The front end of product 108 is guided into product insert station 134 by two guide arms 220 and 222 mounted to automated cartoner 100 through springs 224 and 226, respectively. The top end of product 108 is guided by top guides 230 and 232, which hold product 108 in a downward direction as it is pushed towards carton 114 in the direction of Arrow A. A lifting tab 228 is mounted to guide arm 222 by means of a lifting tab mounting assembly 234.

Figure 16:
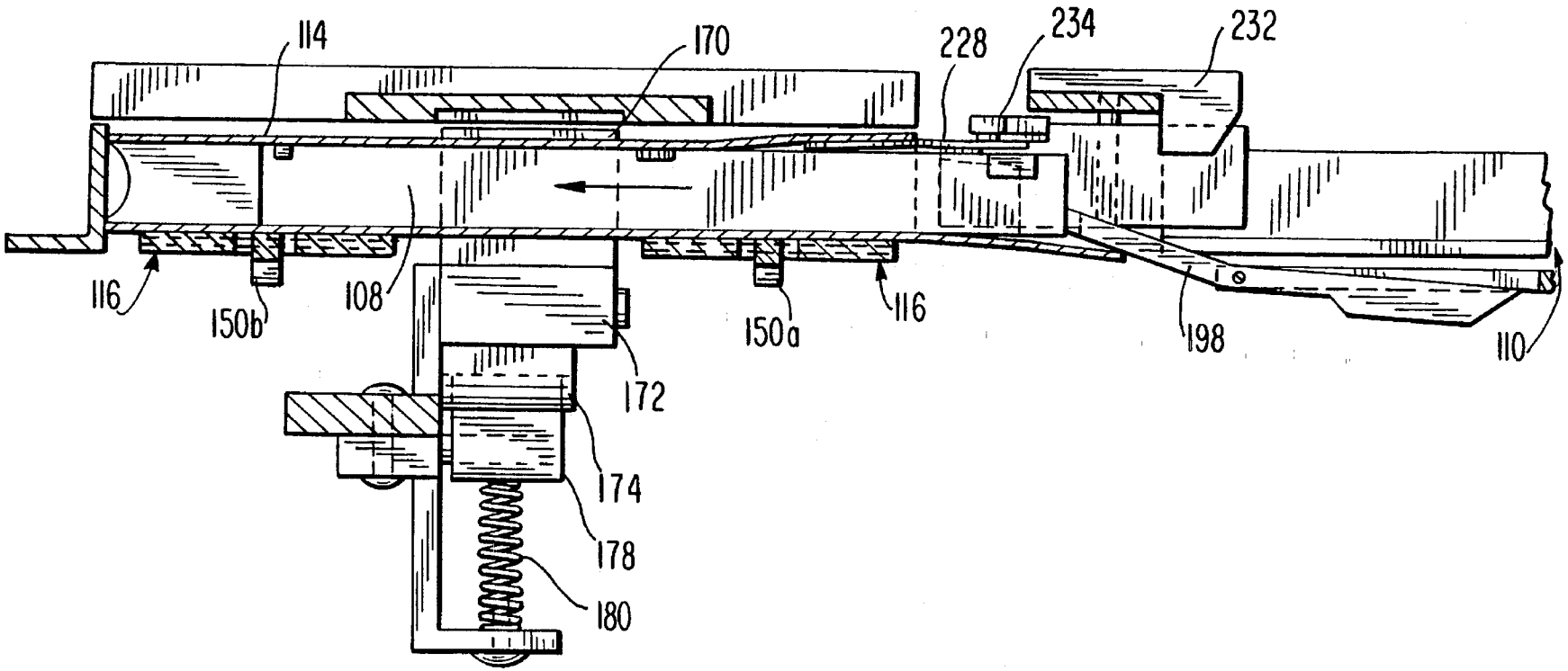
FIG. 16 is an enlarged sectional view taken along lines 16—16 of FIG. 15.

Therefore, as guide arm 222 moves, lifting tab 228 moves in a corresponding direction. More specifically, lifting tab 228 moves towards carton 114 to lift the top edge of carton 114 as product 108 is inserted therein as best shown in FIG. 16. Once product 108 is inserted into carton 114, product slide 110 moves in a direction opposite to Arrow A (i.e. towards product hopper 106). At this time, guide arms 220 and 222 close backwards by means of springs 224 and 226, respectively and carton slide 116 moves in a direction opposite to Arrow B.

As previously set forth, carton slide 116 and product slide 110 operate at 90 degrees with respect to one another in reciprocating directions. Therefore, when product slide 110 moves forward, carton slide 116 moves backwards. Conversely, when product slide 110 moves backwards, carton slide 116 moves forward. This motion is accomplished with right angle drive 242. In the preferred embodiment of the invention, the back and forth movement of the product slide 110 and carton slide 116 can package up to 40 to 60 cartons per minute.

Figure 20:
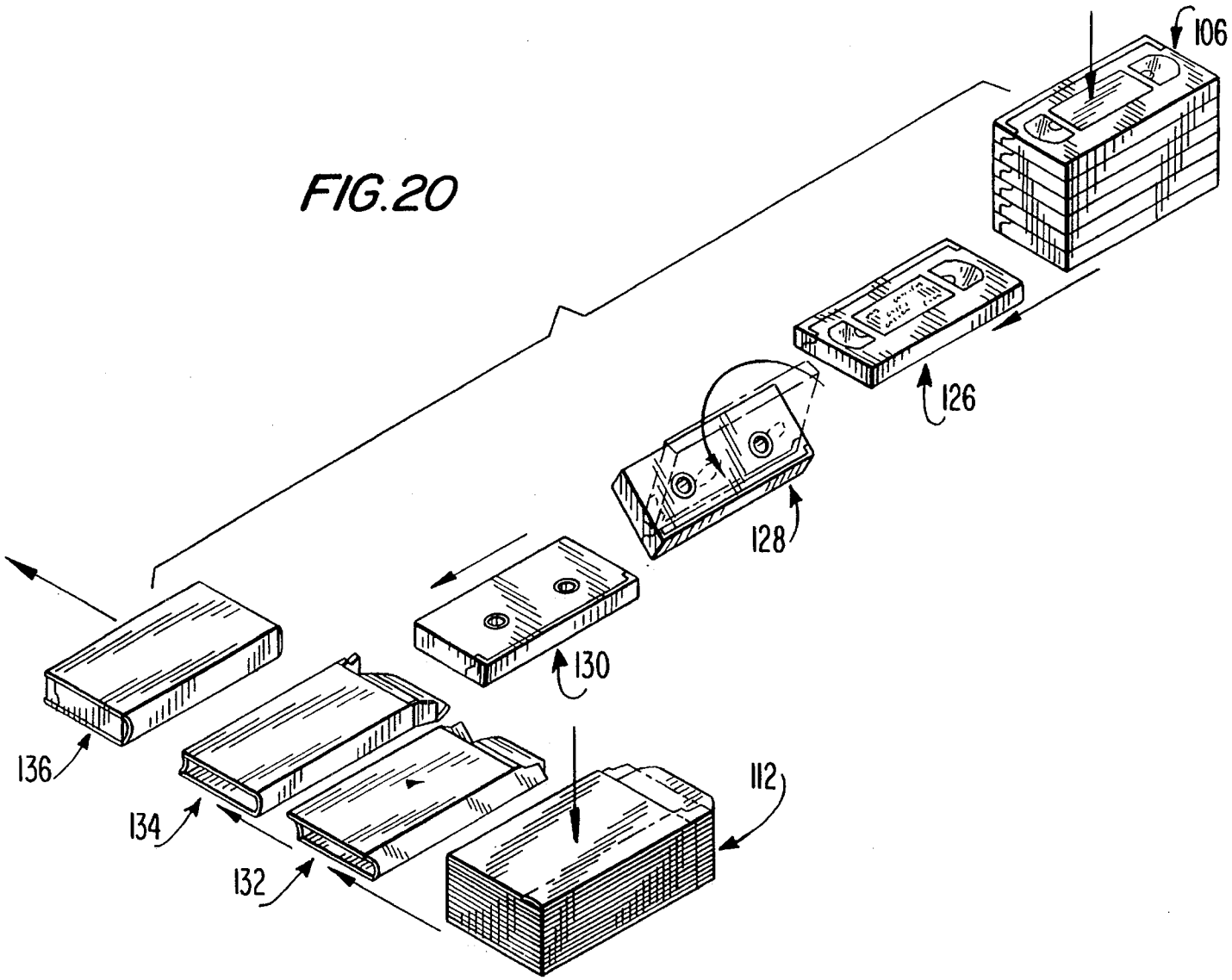
FIG. 20 is a perspective view of the products and cartons at a moment of time without the automated cartoner.

As described above, product slide 110 and carton slide 116 advance product 108 and carton 114 to each of the various stations by means of the various gravity pushers described above. To best explain the movement of carton 114 and product 108, the movement of product 108 along product slide 110 will be first described with reference to FIG. 20. First, a plurality of products 108 are loaded into product hopper 106. When product slide 110 moves forward, gravity pusher 190 pushes product 108 to labeling station 126 as shown in FIG. 20. When product slide 110 retracts, gravity pusher 190 will pivot down about pivot point 192 and product 108 will remain in labeling station 126. The next time product slide 110 moves forward, gravity pusher 190 will push a second product 108 to labeling station 126 and gravity pusher 194 will push the first product 108 to reorienting station 128 as shown in FIG. 20.

When product slide 110 retracts, gravity pushers 190 and 194 will pivot down about the respective pivot points and first product 108 will remain in reorienting station 128 and second product 108 will remain in labeling station 126. The next time product slide 110 moves forward, gravity pusher 190 will push third product 108 to labeling station 126, gravity pusher 194 will push second product 108 to reorienting station 128, while pushing bar 201 will push first product 108 to insert station 130. As pusher bar 201 moves product 108 to insert station 130, gravity pusher 198 will pivot downward until product 108 is pushed in front of it. At that point, gravity pusher 198 returns to an up position. Gravity pushers 190 and 194 as well as pusher bar 201 continue to move in this direction as long as products 108 remain in product hopper 106.

Therefore, rather than repeating their operations, the next step required by the forward movement of product slide 110 is gravity pusher 198 directing first product 108 from insert station 130 into product insert station 134 along carton slide 116. During this movement of product 108, gravity pusher 198, guide arms 220 and 222, lifting tab 228 and top guides 230 and 232 further guide product 108 into carton 114 to create a packaged product as described above with respect to FIGS. 13, 14, 15 and 16. As previously indicated, product slide 110 may be extended with several gravity pushers to add stations as required by the product being inserted into carton 114.

Carton slide 116 operates in the manner similar to that of product slide 110. Flat cartons 114 are loaded into carton hopper 112. When carton slide 116 moves forward, suction cup 146 together with carton pusher 144 deliver flat carton 114 to pre-break station 132 as shown in FIG. 20. When carton slide 116 retracts, carton 114 will remain in pre-break station 132 and a vacuum operated mechanism formed by the combination of suction cups 154, 156 and 158 force the score lines on carton 114 to flex. In other words, the top of carton 114 opens through the movement of suction cup 158 through mounting guide 161 and pre-break assembly 162. By flexing the score lines of cartons 114, they may be easily manipulated when product 108 is inserted therein.

When carton slide 116 moves forward for the second time, gravity pushers 148*a* and 148*b* will move carton 114 to product insert station 134, where stopper 170 will hold carton 114 in an essentially open rectangular position. At the same time, a second carton 114 is moved from carton hopper 112 to pre-break station 132 as best shown in FIG. 20. The second time carton slide 116 retracts, product slide 110 by means of gravity pusher 198 inserts product 108 into carton 114 at product insert station 134, while second carton 114 is pre-broken in pre-break station 132. The movement of product 108 into carton 114 is best described with respect to the discussion above of FIGS. 14–17.

The third time product slide 116 moves forward, gravity pushers 150*a* and 150*b* move the packaged product to folding station 136 as shown in FIG. 20. At the same time, second carton 114 is erected and held open for insertion in product insert station 134 and a third carton is moved from carton hopper 112 to pre-break station 132. There are several carton closing stations within folding station 136 where folding bars are used to fold and insert flaps into the filled cartons. However, these are well known in the art and form no part of the present invention. In this embodiment of the invention, no gravity pushers are used to push the filled cartons through the various closing stations. Instead, each packaged product will push the packaged product in front of it and exit directly to a shrink wrapping machine, not shown.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An automated cartoner for packaging a product in a carton having score lines, comprising:

a carton feed, said carton feed being a storage container for storing a plurality of cartons;

a carton slide having a first end and a second end, said first end coupled to said carton feed for receiving cartons from said carton feed, said carton slide and product slide move in reciprocating directions to one another;

a pre-break station essentially positioned between said first end and said second end of said carton slide for flexing the score lines on said carton, said carton slide including a vacuum means for pulling a carton from said storage container and onto said carton slide and into said pre-break station;

a product feed;

a product slide having a first end and a second end, said second end of said product slide being connected to said carton slide essentially between said pre-break station and said second end of said carton slide to form a packaging station, said first end of said product slide being connected to said product feed for receiving product from said product feed, said product slide delivering said product to said packaging station; and at least one motor for driving said carton slide and said product slide, said carton on said carton slide being driven toward said packaging station, and said product on said product slide being driven towards said packaging station and driving said product into said carton to form a packaged product.

2. The automated cartoner of claim 1, wherein said carton slide includes at least two carton pushing assemblies for pushing said cartons along said carton slide.

3. The automated cartoner of claim 2, wherein said pre-break station includes a vacuum assembly having at least one vacuum means positioned below the carton on said carton slide and at least one vacuum means positioned above the carton on the carton slide, said vacuum means pulling the top and bottom of said carton away from one another to flex the score lines on said carton.

4. The automated cartoner of claim 3, wherein said first carton pushing assembly pushes said carton from said pre-break station to said packaging station.

5. The automated cartoner of claim 4, further including a folding station positioned towards said second end of said carton slide, said second carton pushing assembly pushes said carton with said product therein to said folding station.

6. The automated cartoner of claim 5, wherein said carton pushing assemblies are gravity pushers.

7. The automated cartoner of claim 6, wherein said gravity actuated pushers are weighted so that the top end is lighter than the bottom end.

8. An automated cartoner for packaging a product in a carton having score lines, comprising:

a carton feed;

a carton slide having a first end and a second end, said first end coupled to said carton feed for receiving cartons from said carton feed;

a pre-break station essentially positioned between said first end and said second end of said carton slide for flexing the score lines on said carton;

a product feed, said product feed being a storage container for storing a plurality of products;

a product slide having a first end and a second end, said second end of said product slide being connected to said carton slide essentially between said pre-break station and said second end of said carton slide to form a packaging station, said first end of said product slide being connected to said product feed for receiving product from said product feed, said product slide delivering said product to said packaging station, said product slide including at least two product pushing assemblies for pushing said products along said product slide; and at least one motor for driving said carton slide and said product slide, said carton on said carton slide being driven toward said packaging station, and said product on said product slide being driven towards said packaging station and driving said product into said carton to form a packaged product.

9. The automated cartoner of claim 8, wherein said first product pushing assembly pushes said product out from said product storage container to an insert station positioned between said product storage container and said packaging station.

10. The automated cartoner of claim 9, wherein said second product pushing assembly pushes said product from said insert station to said packaging station, where said product is inserted into said carton to form a packaged product.

11. The automated cartoner of claim 10, wherein said product pushing assemblies are gravity pushers.

12. The automated cartoner of claim 10, wherein said product is inserted into said carton by at least two side guides, at lease one of said side guides being coupled to a top guide for further guiding the product in the carton.

13. An automated cartoner for packaging a product in a carton having score lines, comprising:

a carton feed, said carton feed being a storage container for storing a plurality of cartons;

a carton slide having a first end and a second end, said first end coupled to said carton feed for receiving cartons from said carton feed, said carton slide including at least two carton pushing assemblies for pushing said cartons along said carton slide;

a pre-break station essentially positioned between said first end and said second end of said carton slide for flexing the score lines on said carton, said pre-break station including a vacuum assembly having at least one vacuum positioned below the carton on said carton slide and at least one vacuum positioned above the carton on the carton slide, said vacuums pulling the top and bottom of said carton away from one another to flex the score lines on said carton;

a product feed, said product feed being a storage container for storing a plurality of products;

a product slide having a first end and a second end, said second end of said product slide being connected to said carton slide essentially between said pre-break station and said second end of said carton slide to form a packaging station, said first end of said product slide being connected to said product feed for receiving product from said product feed, said product slide delivering said product to said packaging station;

at least one motor for driving said carton slide and said product slide in reciprocating directions with respect to one another, said carton on said carton slide being driven toward said packaging station, and said product on said product slide being driven towards said packaging station and driving said product into said carton to form a packaged product, said first carton pushing assembly pushes said carton from said pre-break station to said packaging station, and a folding station positioned towards said second end of said carton slide, said second carton pushing assembly pushes said carton with said product therein to said folding station wherein said product feed is a storage container for storing a plurality of products.

14. The automated cartoner of claim 13, wherein said product slide includes at least two product pushing assemblies for pushing said products along said product slide.

15. The automated cartoner of claim 14, wherein said first product pushing assembly pushes said product out from said product storage container to an insert station positioned between said product storage container and said packaging station.

16. The automated cartoner of claim 15, wherein said second product pushing assembly pushes said product from said insert station to said packaging station, where said product is inserted into said carton.

17. The automated cartoner of claim 16, wherein said product pushing assemblies are gravity pushers.

18. The automated cartoner of claim 17, wherein said gravity actuated pushers are weighted so that the top end is lighter than the bottom end.

19. The automated cartoner of claim 16, wherein said carton slide and said product slide are connected at essentially a right angle with respect to one another.

20. The automated cartoner of claim 19, wherein said motor includes a right angle drive to cause said product slide and said carton slide to move in reciprocating directions at approximately 90° with respect to one another.

21. Automated cartoner for packaging a product in a carton having score lines, comprising:

a carton feed;

a carton slide having a first end and a second end, said first end coupled to said carton feed for receiving cartons from said carton feed;

a pre-break station essentially positioned between said first end and said second end of said carton slide for flexing the score lines on said carton;

a product feed;

a product slide having a first end and a second end, said second end of said product slide being connected to said carton slide essentially between said pre-break station and said second end of said carton slide to form a packaging station, said first end of said product slide being connected to said product feed for receiving product from said product feed, said product slide delivering said product to said packaging station, said carton slide and said product slide are connected at essentially a right angle with respect to one another; and at least one motor for driving said carton slide and said product slide, said carton on said carton slide being driven toward said packaging station, and said product on said product slide being driven towards said packaging station and driving said product into said carton to form a packaged product, said at least one motor including a right angle drive to cause said product slide and said carton slide to move in reciprocating directions at approximately 90° with respect to one another.

22. The automated cartoner of claim 21, wherein said product is a videotape cassette.

23. The automated cartoner of claim 21, wherein said carton slide and said product slide are connected at essentially a right angle with respect to one another.

24. A method for inserting a product into a carton having score lines using an automated cartoner including at least one motor for driving a carton slide and a product slide, comprising the steps of:

feeding cartons from a carton feed to said carton slide;

driving said cartons from said carton feed to a pre-break station;

flexing the score lines on said carton at said pre-break station;

feeding product from a product feed to said product slide;

driving said carton slide and said product slide at approximately 90° in reciprocating directions with respect to one another;

driving said product on said product slide towards said packaging station and driving said product into said carton to form a packaged product; and driving said packaged product on said product slide to a folding station.

25. A method for inserting a video tape cassette into a carton having score lines using an automated cartoner including at least one motor for driving a carton slide and a cassette slide, comprising the steps of:

feeding cartons from a carton feed to said carton slide;

driving said cartons from said carton feed to a pre-break station;

flexing the score lines on said carton at said pre-break station;

driving said carton slide and said cassette slide at approximately 90° in reciprocating directions with respect to one another;

feeding video tape cassettes from a cassette feed to said cassette slide;

driving said videotape cassette on said cassette slide towards said packaging station and driving said videotape cassette into said carton to form a packaged product; and driving said packaged product on said cassette slide to a folding station.

26. An automated cartoner for packaging a product in a carton, comprising:

a carton slide having a first end and a second end, said first end for receiving cartons;

a product slide having a first end and a second end, said second end of said product slide being connected to said second end of said carton slide essentially between said first end and said second end of said product slide and essentially a right angle with respect to one another to form a packaging station, said first end of said product slide for receiving product, said product slide delivering said product to said packaging station; and at least one motor for driving said carton slide and said product slide, said carton on said carton slide being driven toward said packaging station, and said product on said product slide being driven towards said packaging station and driving said product into said carton to form a packaged product, said at least one motor including a right angle drive unit to cause said product slide and said carton slide to move in reciprocating directions at approximately 90° with respect to one another.

* * * * *